US012716643B2

(12) United States Patent
McAleer

(10) Patent No.: US 12,716,643 B2
(45) Date of Patent: Aug. 25, 2026

(54) REFRIGERATED COOLER AND ASSOCIATED COOLER LID LATCH SYSTEM

(71) Applicant: ILLINOIS TOOL WORKS INC., Glenview, IL (US)

(72) Inventor: Li McAleer, Fort Worth, TX (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 301 days.

(21) Appl. No.: 18/506,409

(22) Filed: Nov. 10, 2023

(65) Prior Publication Data

US 2025/0155188 A1 May 15, 2025

(51) Int. Cl.

| | |
|---|---|
| ***F25D 23/02*** | (2006.01) |
| ***F25D 11/00*** | (2006.01) |
| *A47F 3/04* | (2006.01) |

(52) U.S. Cl.

CPC ..... *F25D 23/028* (2013.01); *F25D 11/00* (2013.01); *A47F 3/043* (2013.01); *F25D 23/026* (2013.01)

(58) Field of Classification Search

CPC ..... F25D 23/028; F25D 23/026; F25D 11/00; A47F 3/043; E05B 65/0042; E05C 3/047

See application file for complete search history.

(56) References Cited

U.S. PATENT DOCUMENTS

2019/0338999 A1* 11/2019 Lee ..... E05C 1/12
2020/0240178 A1* 7/2020 Ayyawar ..... F25D 23/028
2022/0403687 A1* 12/2022 Notohardjono ..... E05B 17/2088

OTHER PUBLICATIONS

Admitted prior art, 2 pages.

* cited by examiner

*Primary Examiner* — Joseph F Trpisovsky
(74) *Attorney, Agent, or Firm* — THOMPSON HINE LLP

(57) ABSTRACT

A refrigerated cooler includes a housing including a lower portion and an upper portion, at least the lower portion of the housing defining a compartment, the compartment having an access opening facing upwardly. A cooling system is provided for cooling the compartment. A lid member is pivotable between a closed position covering the access opening and an open position that uncovers the access opening. A latching assembly includes a first latching part on the lid member and a second latching part on the upper portion of the housing, wherein the second latching part engages with the first latching part to retain the lid member in the open position. At least a latching segment of the second latching part is movable upward, when contacted by the first latching part as the lid member moves toward the open position, so as to automatically shift the latching segment upward.

10 Claims, 6 Drawing Sheets

REFRIGERATED COOLER AND ASSOCIATED COOLER LID LATCH SYSTEM

TECHNICAL FIELD

This application relates generally to a refrigerated cooler that holds food items and, more particularly, to a refrigerated cooler with a cooler lid that pivots upward to allow access to items stored in the cooled compartment of the cooler.

BACKGROUND

Refrigerated coolers are used for storing food items, such as drinks, to be retrieved and consumed by consumers. For example, food coolers are often provided in cafeteria environments to store milk and other drinks. Access to the cooled compartment in which the drinks are stored is by pivoting of a cooler lid upward to an open position. A latching system retaining the cooler lid in the open position is often provided and may take the form of a ball and detent catch in which a spring-loaded ball unit is mounted on an upper front side of a housing of the cooler in a position such that the spring-loaded balls are releasably engageable with recessed portions on opposite sides of a catch mounted to the cooler lid, where the catch moves upward between the spaced apart spring-loaded balls when the cooler lid moves to the open position. One issue with this latching system is that forces applied to the cooler lid can overcome the spring-load of the balls causing the cooler lid to fall to the closed position. To address this issue, previous coolers have also included a swing hook mounted a side portion of the housing and engageable with an eye component on the cooler lid. This two latch system increases cost and difficulty of proper use.

It would be desirable to provide a refrigerated cooler with an improved cooler lid latching system.

SUMMARY

In one aspect, a refrigerated cooler includes a housing including a lower portion and an upper portion, at least the lower portion of the housing defining a compartment, the compartment having an access opening facing upwardly. A cooling system is provided for cooling the compartment. A lid member is pivotable between a closed position covering the access opening and an open position that uncovers the access opening. A latching assembly includes a first latching part on the lid member and a second latching part on the upper portion of the housing, wherein the second latching part engages with the first latching part to retain the lid member in the open position. The second latching part comprises a movable latch cam that, when contacted by the first latching part as the lid member moves toward the open position, shifts at least a part of the movable latch cam upward such that the movable latch cam can engage over the first latching part to retain the lid member in the open position.

In another aspect, a refrigerated cooler includes a housing including a lower portion and an upper portion, at least the lower portion of the housing defining a compartment, the compartment having an access opening facing upwardly. A cooling system is provided for cooling the compartment. A lid member is pivotable between a closed position covering the access opening and an open position that uncovers the access opening. A latching assembly includes a first latching part on the lid member and a second latching part on the upper portion of the housing, wherein the second latching part engages with the first latching part to retain the lid member in the open position. At least a latching segment of the second latching part is movable upward, when contacted by the first latching part as the lid member moves toward the open position, so as to automatically shift the latching segment upward.

In a further aspect, a refrigerated cooler includes a housing including a lower portion and an upper portion, at least the lower portion of the housing defining a compartment, the compartment having an access opening facing upwardly, a cooling system for cooling the compartment, and a lid member pivotable between a closed position covering the access opening and an open position that uncovers the access opening. A latching assembly includes a first latching part on the lid member and a second latching part on the upper portion of the housing, wherein the first latching part and the second latching part automatically engage with each other when the lid member is moved to the open position to retain the lid member in the open position. At least one of the first latching part or the second latching part comprises a manual release part, wherein the manual release part is positioned lower than a free end edge of the lid member when the lid member is in the open position and the first latching part and the second latching part are latchingly engaged.

The details of one or more embodiments are set forth in the accompanying drawings and the description below. Other features, objects, and advantages will be apparent from the description and drawings, and from the claims.

DETAILED DESCRIPTION

Figure 1:
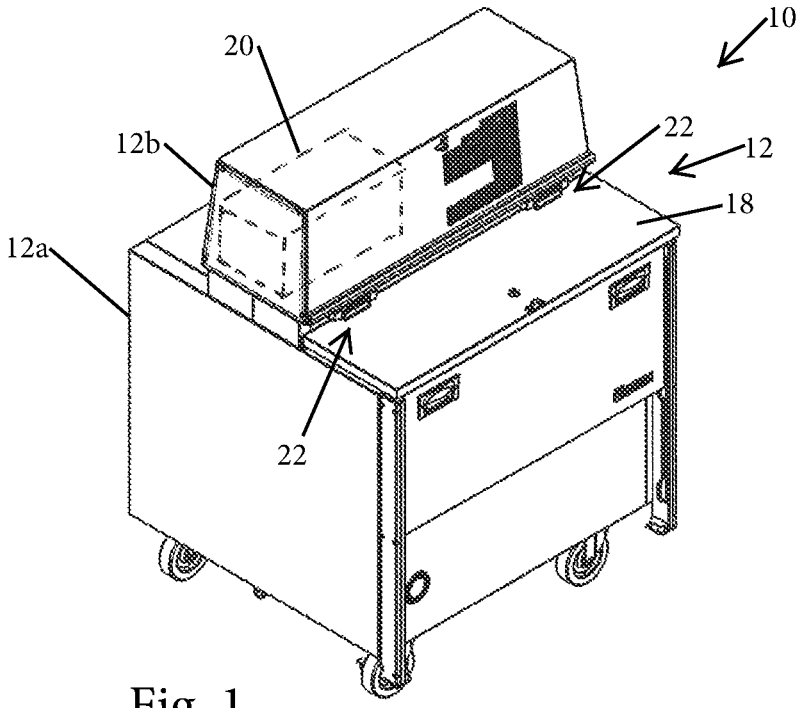
FIG. 1 shows a refrigerated cooler with lid closed.
Figure 2:
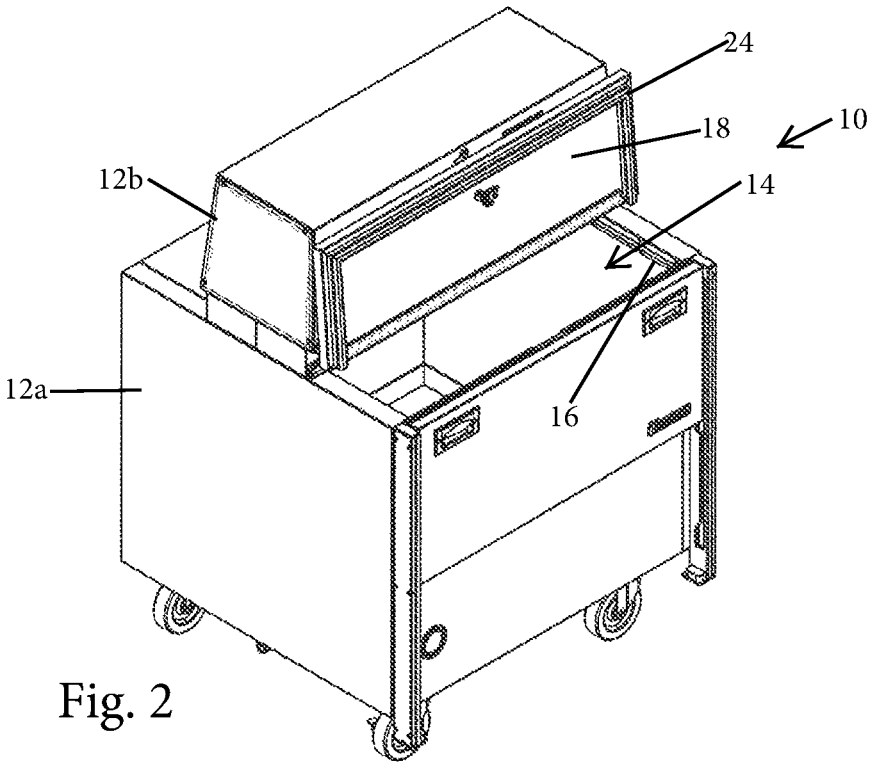
FIG. 2 shows the refrigerated cooler with lid open.
Figure 3:
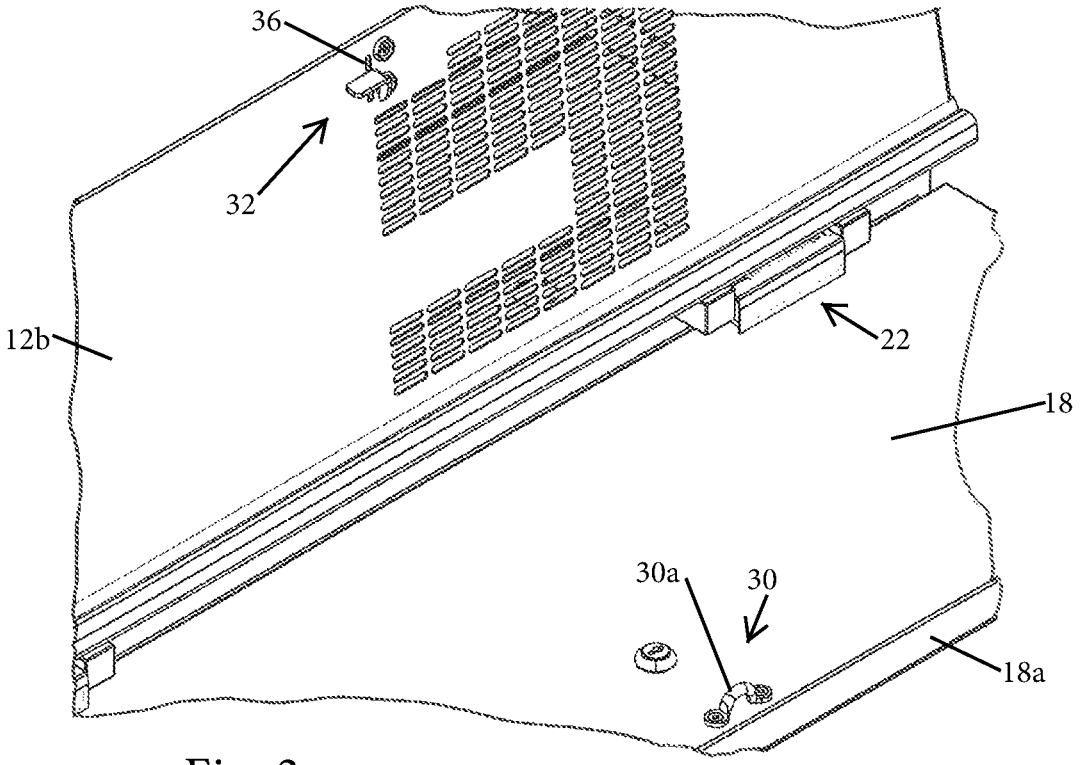
FIGS. 3 and 4 show enlarged regions of the refrigerated cooler with lid closed.
Figure 4:
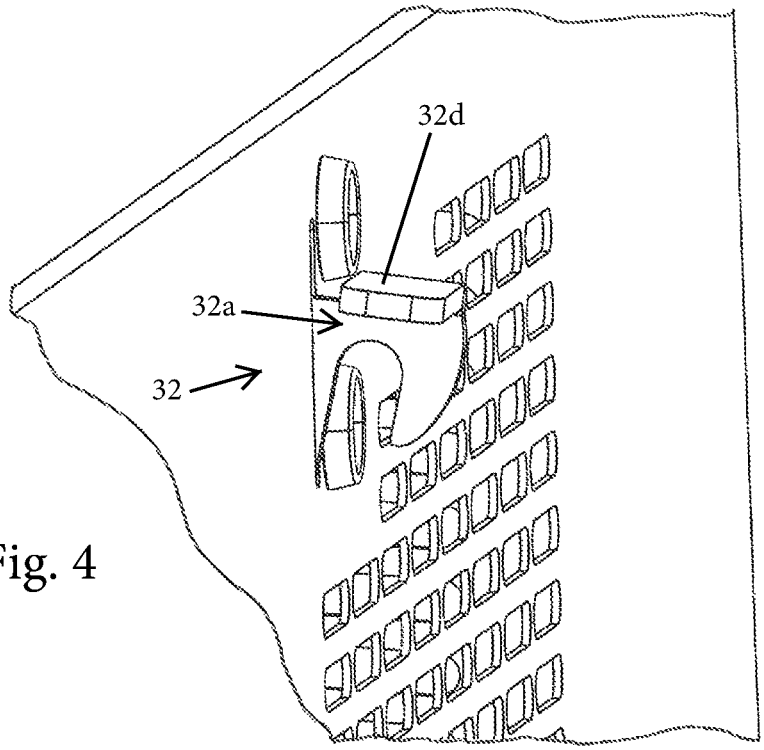
Figure 5:
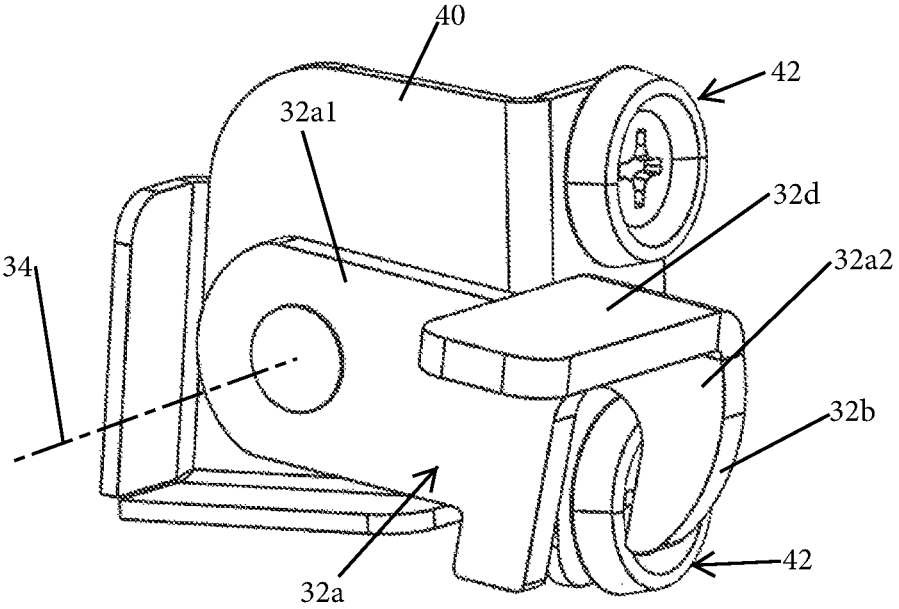
FIGS. 5, 6 and 11 show the latching features of the refrigerated cooler in isolation.
Figure 6:
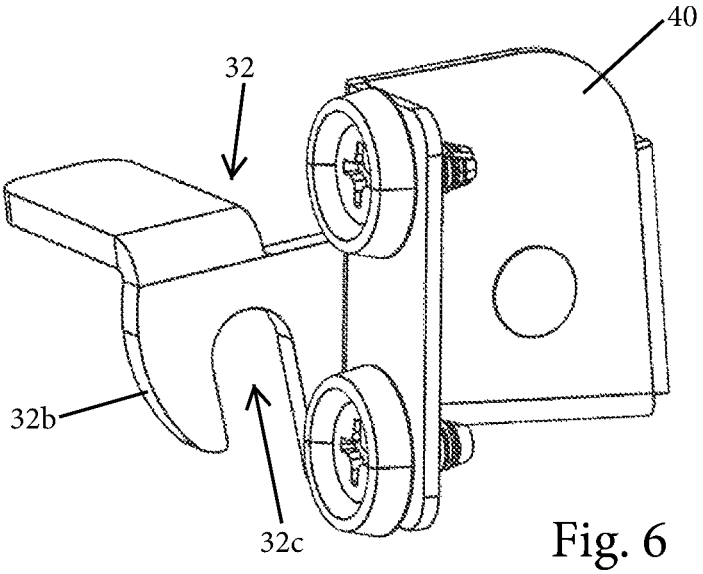
Figure 7:
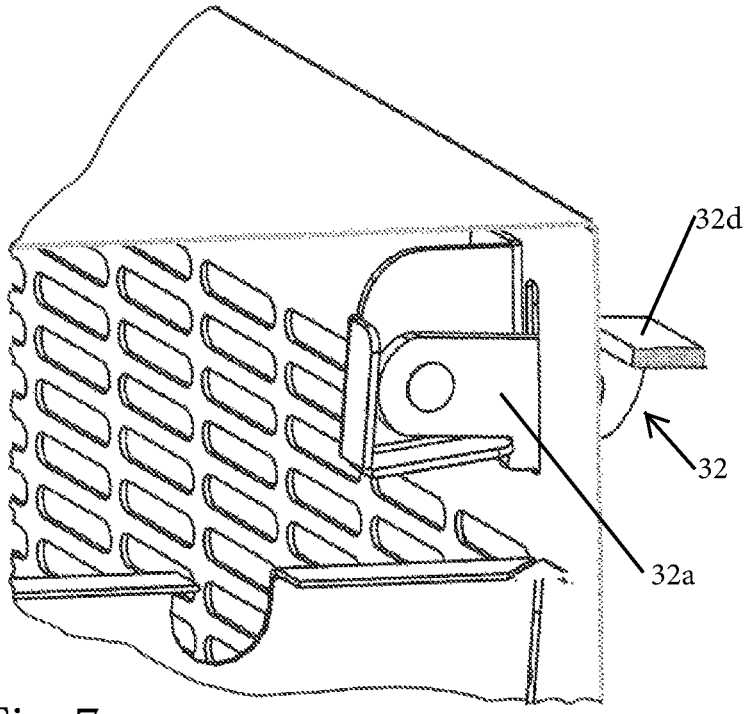
FIGS. 7 and 8 show partial cross-sections depicting mounting of the housing latching part.
Figure 8:
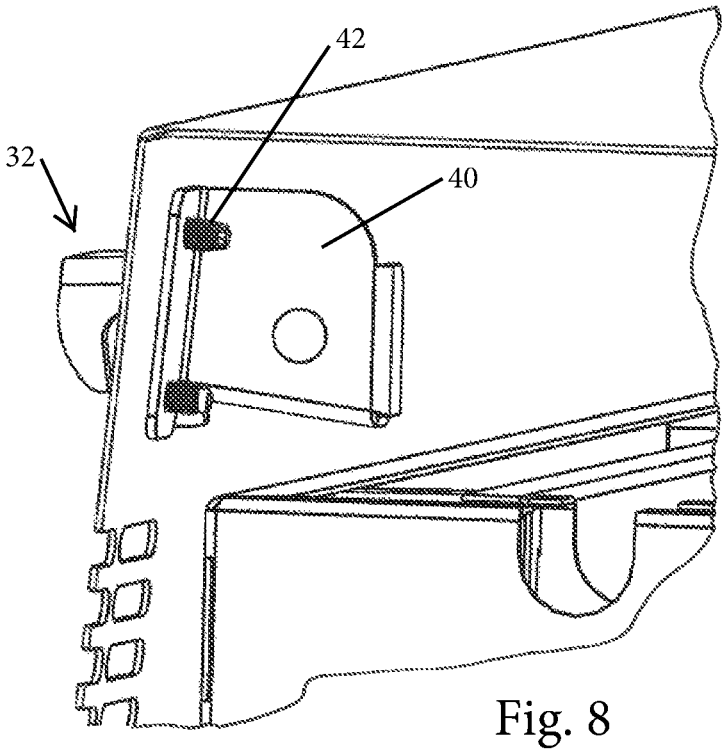
Figure 9:
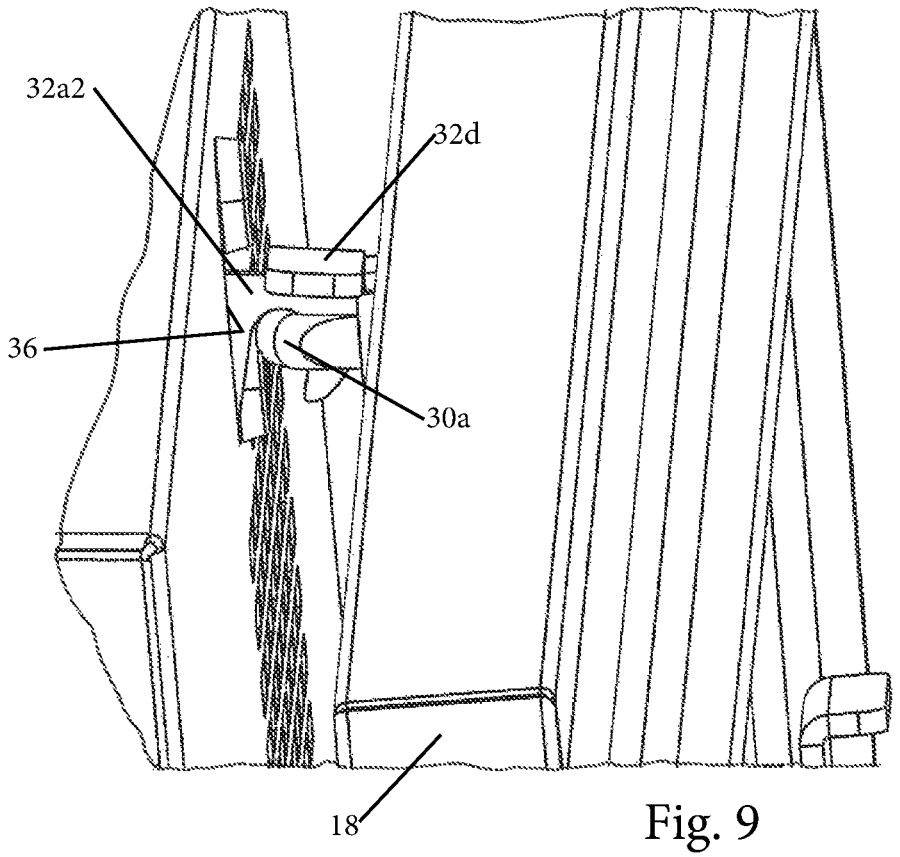
FIG. 9 shows an enlarged view of a region of the refrigerated cooler with lid latched open.
Figure 10:
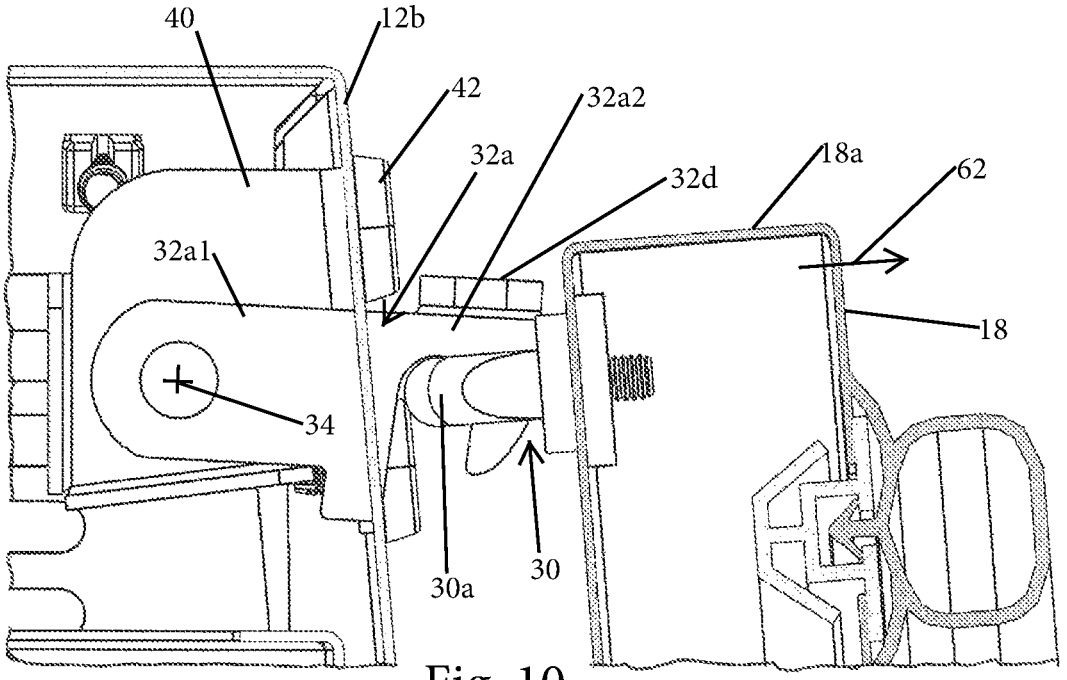
FIG. 10 shows a partial cross-section, in side elevation, of a region of the refrigerated cooler with lid latched open.

Referring to FIGS. 1-11, a refrigerated cooler 10 includes a housing 12 (e.g., frame and panels) with a cooled compartment 14 having an upwardly facing opening 16 that is closeable by a lid 18 that is pivotably movable between a lowered, closed position (FIG. 1) that covers the opening 16 and a raised, open position (FIG. 2) that uncovers the opening 16. A cooling system 20 (e.g., refrigeration system with a refrigerant circuit including a condenser, compressor and evaporator, and a fan for moving air that is cooled) and internal ducting is provided for cooling the compartment 14.

The housing 12 including a lower portion 12*a* and an upper portion 12*b*. Here, the upper portion 12*b* extends upward from the lower portion 12*a* at a location along the depth of the housing. The lower portion 12*a* primarily defines the compartment 14, and the access opening 16 faces upwardly. In embodiments, the upwardly facing access opening 16 may be substantially horizontal, while in other embodiments the upwardly facing access opening 16 may be offset at an angle relative to horizontal (e.g., offset at an angle of between five degrees and sixty degrees).

The lid 18 includes an inward edge with pivot mounts 22 located on a lower section of the upper housing 12*b*. The lid 18 may include a peripheral gasket seal 24 to provide effective sealing of the compartment 14 when the lid is closed.

The lid 18 carries a latching part 30 and the upper portion 12*b* of the housing carries a latching part 32, where the latching part 32 engages with the latching part 30 to retain the lid member in the open position. Here, the latching part 30 comprises a pad eye 30*a* that is fastened to the outer surface of the lid 18. Here, the latching part 32 comprises a movable latch cam 32*a* that, when contacted by the latching part 30, 30*a* as the lid 18 moves toward the open position, shifts at least a part of the movable latch cam 32*a* upward such that the movable latch cam can engage over the latching part 30 to retain the lid 18 in the open position. For this purpose, the movable latch cam 32*a* includes a cam surface 32*b* facing outward from the upper housing 12*b* and that is configured such that sliding interaction with the latching part 30 will create a reactive force (e.g., 60) that shifts at least the external part of the movable latch cam upward. The movable latch cam 32*a* includes a downwardly facing slot 32*c* that engages over the latching part 30 when the latching part 30 moves past the cam surface 32*b* and allows the movable latch cam to shift back downward. The downwardly facing slot 32*c* is shaped and configured such that a force (e.g., 62) applied to the lid 18 to urge the lid to move back toward the closed position will not cause the movable latch cam to shift upward, such that the lid 18 is retained in the open position by interaction of the downwardly facing slot 32*c* and the latching part 30. Thus, the need for a separate swing hook is eliminated.

Figure 11:
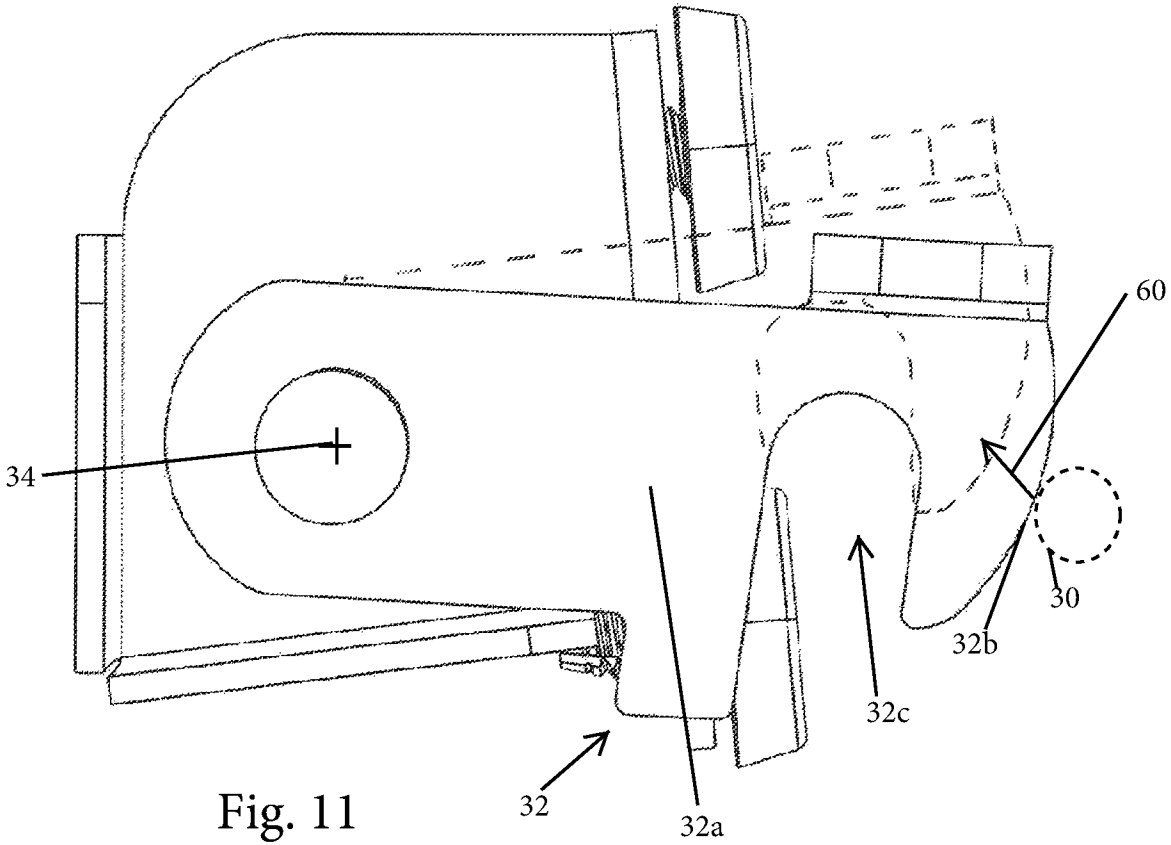

Here, the movable latch cam 32*a* is pivotably mounted to the upper portion 12*b* of the housing, and the reactive force 60 causes upward pivot of the external part of the movable latch cam 32*a*, per the dashed line position in FIG. 11. In particular, a pivot axis 34 of the movable latch cam 32*a* is located internally of the upper portion of the housing on a mount segment 32*al* of the movable latch cam 32*a* and a latching segment 32*a*2 of the movable latch cam protrudes outwardly through an opening 36 (here a vertical slot) in the upper portion 12*b* of the housing. A bracket 40 is mounted internally of the upper portion 12*b* of the housing (e.g., by fasteners 42) to provide the pivot mount for the movable latch cam 32*a*. The movable latch cam is mounted such that the external part of the movable latch cam is biased downward. Here, the biasing is provided by gravity based upon the position of the pivot axis 34 and the relative weight of the movable latch cam portions on opposite sides of the pivot axis. However, alternative or additional biasing could be included, such as by one or more springs.

Notably, the movable latch cam 32*a* is positioned lower than a free end edge 18*a* of the lid 18 when the lid is in the open position and the movable latch cam 32*a* is engaged over the latching part 30, 30*a* to retain the lid in the open position. Further, the movable latch cam 32*a* includes a handle part 32*d* for manually raising the movable latch cam 32*a* to allow disengagement of the movable latch cam 32*a* from the latching part 30 so that the lid 18 can be closed. The handle part 32*d* is positioned lower than the free end edge 18*a* of the lid when the lid is in the open position and the movable latch cam 32*a* is engaged over the latching part 30 to retain the lid member in the open position. This configuration reduces the likelihood that a person will accidentally shift the movable latch cam 32*a* to an unlatched state that would permit the lid to move to the closed position.

It is to be clearly understood that the above description is intended by way of illustration and example only, is not intended to be taken by way of limitation, and that other changes and modifications are possible. For example, although the latching part 32 is pivotally mounted in the illustrated embodiment, the latching part 32 could, alternatively be mounted for sliding movement upward and downward.

The invention claimed is:

1. A refrigerated cooler, comprising:

a housing including a lower portion and an upper portion, at least the lower portion of the housing defining a compartment, the compartment having an access opening facing upwardly;

a cooling system for cooling the compartment;

a lid member pivotable between a closed position covering the access opening and an open position that uncovers the access opening;

a latching assembly including a first latching part on the lid member and a second latching part on the upper portion of the housing, wherein the second latching part engages with the first latching part to retain the lid member in the open position;

wherein the second latching part comprises a movable latch cam that, when contacted by the first latching part as the lid member moves toward the open position, shifts at least a part of the movable latch cam upward such that the movable latch cam can engage over the first latching part to retain the lid member in the open position.

2. The refrigerated cooler of claim 1, wherein the movable latch cam includes a cam surface facing outward from the upper housing and that slidingly interacts with the first latching part to shift at least the part of the movable latch cam upward.

3. The refrigerated cooler of claim 2, wherein the movable latch cam includes a downwardly facing slot that engages over the first latching part when the first latching part moves past the cam surface and allows the movable latch cam to shift back downward.

4. The refrigerated cooler of claim 3, wherein the downwardly facing slot is shaped such that a force applied to the lid member to urge the lid member to move back toward the closed position will not cause the movable latch cam to shift upward, such that the lid member is retained in the open position by interaction of the downwardly facing slot and the first latching part.

5. The refrigerated cooler of claim 2, wherein the movable latch cam is pivotably mounted to the upper portion of the housing.

6. The refrigerated cooler of claim 5, wherein a pivot axis of the movable latch cam is located internally of the upper portion of the housing and a latching segment of the movable latch cam protrudes outwardly through an opening in the upper portion of the housing.

7. The refrigerated cooler of claim 1, wherein the movable latch cam is positioned lower than a free end edge of the lid member when the lid member is in the open position and the movable latch cam is engaged over the first latching part to retain the lid member in the open position.

8. The refrigerated cooler of claim 1, wherein the movable latch cam includes a handle part for manually raising the movable latch cam to allow disengagement of the movable latch cam from the first latching part, wherein the handle part is positioned lower than a free end edge of the lid member when the lid member is in the open position and the movable latch cam is engaged over the first latching part to retain the lid member in the open position.

9. The refrigerated cooler of claim 1, wherein the movable latch cam is mounted such that the part of the movable latch cam is biased downward.

10. The refrigerated cooler of claim 1, wherein the part of the movable latch cam is biased downward by gravity.

* * * * *